US005160484A

United States Patent [19]

Nikoloff

[11] Patent Number: 5,160,484

[45] Date of Patent: Nov. 3, 1992

[54] PAPER SATURANT

[75] Inventor: Koyu P. Nikoloff, North Kingston, R.I.

[73] Assignee: Cranston Print Works Company, Cranston, R.I.

[21] Appl. No.: 590,029

[22] Filed: Sep. 28, 1990

[51] Int. Cl.[5] ..... B05D 1/18

[52] U.S. Cl. ..... 427/439; 162/158; 428/511; 524/276; 524/517; 524/512

[58] Field of Search ..... 106/271; 162/158, 164.1, 162/164.3, 164.6, 164.7, 168.1, 168.2, 168.3, 168.5, 168.7, 169; 427/391, 439; 428/511; 524/276, 512, 517

[56] References Cited

U.S. PATENT DOCUMENTS

| | | | |
|---|---|---|---|
| 3,872,039 | 3/1975 | Vaughn et al. | 162/164.6 X |
| 3,899,389 | 8/1975 | Vaughn et al. | 162/168.5 X |
| 4,181,566 | 1/1980 | Vaughn et al. | 162/164.6 X |
| 4,571,360 | 2/1986 | Brown et al. | 422/373 X |

*Primary Examiner*—Michael Lusignan

[57] ABSTRACT

A non-latex composition for saturating paper comprising a suitable hydrophobic sizing agent, ethylene acrylic acid co-polymer, and a softening agent. The ethylene acrylic acid copolymer is provided as bulk or solvent polymerized solid and rendered soluble in an aqueous alkali solution. The paper may be formulated to be repulpable. Methods for making the paper-saturating composition, methods for saturating paper, and the resulting paper are also disclosed.

19 Claims, 1 Drawing Sheet

PAPER SATURANT

BACKGROUND OF THE INVENTION

This invention relates to compositions and methods for saturating paper to provide desirable properties such as water resistance, wet strength, flexibility, softness, durability, fold resistance, drapability, in products such as wallpaper, book covers, map and label stock.

Many currently available paper products are saturated in production to provide the above properties. For wallpaper, strippability is also an important feature. Typically, the paper is saturated with a latex emulsion, after which other treatments such as ground coating, printing, and scrubb-resistant resin coatings are applied. Typically, the latex used to saturate such papers is provided as an emulsion, e.g. of a latex such as styrene butadiene (SBR), polyvinyl acetate, a vinyl acrylic, an ethylene vinyl acetate, or an acrylic emulsion. Such latices are impervious to water when dried and/or cured. Fig. 1 shows in highly diagrammatic form the various layers of a strippable latex-saturated wallpaper.

Processes involving latex treatment of paper have an inherent disadvantage because the latex generally cannot be removed from the treated paper, and, therefore, the treated paper cannot be repulped/recycled. If there is a production reject or a difficulty requiring stoppage, a large volume of unusable paper must be discarded, e.g. to a landfill, contributing to a significant environmental problem. Latices also present serious difficulties with expensive felts and wires used in paper making. Specifically, use of latex is likely to cause spots or sticky areas on felts or wires, which cause problems in cleaning the felts. It is common to produce latex-treated papers in short runs to reduce the amount of paper that is wasted if a run is outside specification or if other problems are encountered.

Stauntson et al. U.S. Pat. No. 3,574,656 disclose a ground-coated wallpaper with a removable washable surface coating of alkyl acrylate (and/or methacrylate) in combination with vinylidene chloride copolymer. Various other monomers may be present.

SUMMARY OF THE INVENTION

One aspect of the invention generally features a composition for saturating paper, comprising an aqueous mixture of a suitable hydrophobic sizing agent together with ethylene acrylic acid co-polymer (EAA) and a softening agent. The ethylene acrylic acid co-polymer is provided as solid polymer (e.g. bulk or solution polymerized solid) and rendered soluble in an aqueous alkali in order to produce the aqueous mixture.

In preferred embodiments, the solids in the composition are in the following ranges (by weight):

| | |
|---|---|
| sizing agent | 30–60% |
| EAA | 20–50% |
| softener | 20–50% |

The preferred pH is close to neutral or basic (i.e. over 6.5). The softeners may be non-ionic or anionic compounds (e.g. surfactants). Most preferably softening is provided by organic molecules having between 14 and 22 carbon atoms, such as ethoxylated fatty acids, ethoxylated fatty alcohols, glyceryl monoesters, polyhydric alcohols, or a combination thereof. The mixture may be manufactured as a concentrate (total solids up to 60% by weight) and diluted with an aqueous solution to desired solid loading (e.g. 8–25% by weight).

A second aspect of the invention features a method for making an aqueous mixture for saturating paper stock by providing ethylene acrylic acid co-polymer in solid form and solubilizing it in an aqueous alkali, and then combining the solution with a hydrophobic sizing agent and at least one softening agent.

A third aspect of the invention features making saturated paper by providing paper and saturating the paper with the above-described aqueous mixture. The paper-making method according the invention permits saturation of more open, higher moisture content papers, e.g. papers which arrive at the size press with 2–5% moisture and which can be rapidly processed to the finishing reel without extensive drying (e.g. the paper can have over 8% moisture at the finishing reel). Preferably, wet strength is enhanced by an additive provided in the paper-making slush (e.g. at 0.5–4.0% by dry weight of the paper before saturation).

A fourth aspect of the invention features a paper product comprising a saturant as described above.

The invention provides a non-latex (i.e., the polymer is solubilized from solid as opposed to being emulsified) paper product that is useful, for example in a strippable wallpaper. The product provides drapability suitable for wallpaper. Moreover, the wet-strength saturant may be applied in one step without adding steps to existing paper-manufacturing techniques. Most important, the saturant avoids significant picking, sticking or blocking of treated paper, and it provides a surface suitable for ground coating and printing. The paper may be formulated so that when problems are encountered in production, or a run of paper is outside of specification, the paper can be repulped/recycled instead of being sent to landfill. Additionally, the mixtures according to the invention, once formulated as concentrates, can be readily shipped and stored for significant periods before dilution and use in paper manufacture. The shelf life of such mixtures is generally superior to that of latex coating materials.

Other features and advantages are apparent from the following description of the preferred embodiments of the invention.

DESCRIPTION OF THE PREFERRED EMBODIMENTS

PAPER MANUFACTURE

To manufacture a repulpable paper suitable for saturation at the size press with the composition of Example 1 or Example 2, below, the paper-making furnish is provided with a suitable source of paper fiber and the following additives:

a) Wet Strength: acrylamide copolymer (either anionic or cationic) or a glyoxalated acrylamide copolymer supplied by Bercen, Inc, (Cranston, RI) or a melamine formaldehyde acid colloid from Bercen, Inc.; and b) Other Additives: an anionic polyacrylamide dry strength polymer, supplied by Bercen, Inc. The furnish also can include a cationic starch and standard paper additives such as aluminum sulfate, an organic cationic polyelectrolyte, titanium dioxide, or clay.

If repulpability is not required, suitable wet/dry strength can be provided by polyamide epichlorohydrin resin such as those supplied by Hercules (Wilmington, Del.) or Borden.

In the above formulation, it is particularly important to develop wet strength from components in the furnish (e.g. glyoxylated acrylamide copolymer or melmine formaldehyde acid colloid), because the saturant applied at the size press described above does not provide wet-strength comparable to that provided by latices used in the art.

Figure 1:
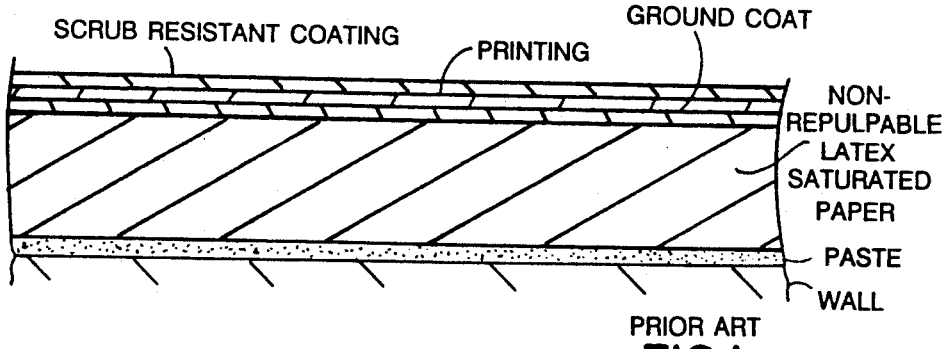
PRIOR ART FIG.1
FIG. 1 shows a prior art paper product.
Figure 2:
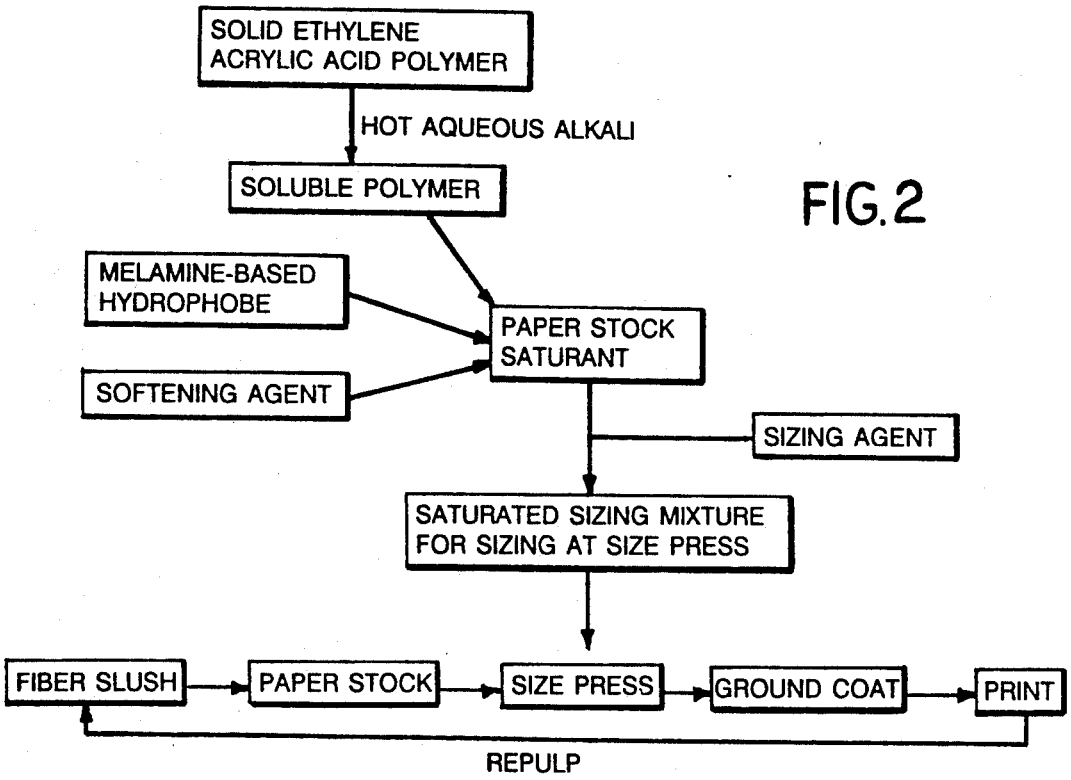
FIG. 2 shows a process for making a repulpable, ground coated, printed paper product according to the invention.
Figure 3:
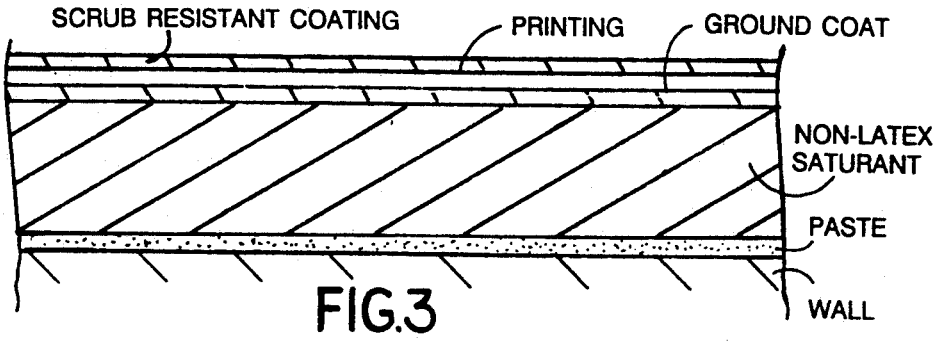
FIG. 3 shows a paper product according to the invention.

Standard paper-making techniques are used to produce a paper from the above-described furnish. The resulting paper is provided to a size press, where the saturant according to the invention is added. See FIG. 2. The saturated paper product is then subjected to other treatments and coatings. See FIG. 3.

The paper entering the size press should be relatively open, having a moisture content of about 2–5%. Depending on the base furnish and machine conditions and grade requirements, pick-up of between 5–15% solids will occur at the size press.

PAPER SATURANT

An aqueous paper saturant for use at the size press is produced as follows. Solid ethylene acrylic acid copolymer (mw=3,000-14 20,000, averaging about 18,000) is rendered water soluble by dissolving in hot aqueous alkali. Specifically, bulk or solution polymerized ethylene acrylic acid beads are mixed in alkali (e.g. NaOH or KOH) at or near boiling. One suitable solid ethylene acrylic acid copolymer is PRIMACOR® sold by Dow Chemical Co.

Other components are then added to form the aqueous saturant. Specifically, those components include a softeners such as fatty acid ethyoxylates, fatty alcohol ethoxylates, glyceryl monostearate, or fatty carbamides, sold by many suppliers including GAF Corp. of Wayne, N.J. or Henkel Chemical of Charlotte, N.C.

The mixture is cooled and the sizing emulsion is added. Specific sizing agents such as polymeric melamine hydrophobes (sold by Bercen, Inc.), wax emulsions (sold by Bercen, Inc., or styrene maleic anhydride (sold by Bercen, Inc.) may be used.

The saturant mixture is produced as a concentrate (20 to 60% solids) which can be stored and shipped to the site of paper manufacture. For use, it is diluted to 8 to 25% solids. The sizing/saturant mixture is added to the paper at the size press, resulting in a wet-strength paper product that can be ground coated, printed or otherwise treated according to known techniques.

In the event of interruption or deviation from specification during the paper-making process, the waste material can be repulped.

A particular advantage of the invention is avoidance of the need to completely dry the paper before it reaches the finish roll. With standard latices, it is important to reduce water content below 2% at the size press and at the finish roll, because moisture may cause the latex-saturated paper layers to fuse, block or stick. In contrast, the invention avoids excessive drying and allows the use of faster machine speeds, with 8% moisture in the finish reel, without blocking or sticking.

The following examples are provided to illustrate the invention, not to limit it.

EAA EXAMPLE 1

SOLUBILIZING AND FORMING SATURANT CONTAINING MELAMINE HYDROPHOBE SIZE

Solid EAA (PRIMACOR® available from Dow Chemical Co., average m.w.~18000) is mixed with hot aqueous alkali (½ hr. at 90° C. or more at a concentration of 35% solids of less) to render the resin soluble. The solubilized EAA is then mixed with softeners and cooled. To the cooled mixture is added a sizing emulsion, to yield the following compositions:

| | % Dry Weight |
|---|---|
| EAA (Primacor ®) | 30 |
| Softeners | |
| Stearic acid ethoxylate (23 to 40 mols) | 12.0 |
| Lauryl alcohol ethoxylate (23 mols) | 1.6 |
| Glyceryl monostearate | 16.6 |
| Polyhydric alcohol | 20.8 |
| Total softener | 51 |
| Bersize 6321 (Bercen, Inc) (melamine hydrophobe size) | 19 |
| | 100% |

The composition is produced to have a solid content of about 40%.

EXAMPLE 2

SOLUBILIZING EAA AND FORMING SATURANT CONTAINING SMA SIZE

EAA is solubilized in a mixture containing surfactants and softeners as described above in Example 1. In place of the melamine hydrophobe size of Example 1, a styrene maleic anhydride solution is prepared by dissolving SMA in hot aqueous alkali at 60°–70° C. to form a solution at 20–40% solids (Bersize 6625 from Bercen, Inc.).

The relative composition of the saturant is the same as in Example 1.

OTHER EMBODIMENT

Other size agents that can be included in the saturant and applied at the size press include anionic/nonionic paraffin wax emulsions (Bercen, Inc.).

Other softening agents, for replacing some or all of the fatty alcohol or fatty acid ethoxylate softeners, include: fluorochemicals; sulfonated tallow; polyethylene emulsions; fatty carbamides; aliphatic hydrocarbon emulsions; sorbitol/urea solution; glycerine; urea; hexylene glycol; and hydrocarbon oil emulsion.

Still other softeners include: trimethyl tallow ammonium chloride; polyglycol; sodium alkyl sulfonate; polyamine epichlorohydrin; EO/PO copolymer; isostearic acid; ammonium oleate; butoxyethyl stearate; isopropyl palmitate; phospholipid; cationic starch.

I claim:

1. A composition for saturating paper, said composition comprising an aqueous mixture of:
   - a suitable hydrophobic sizing agent;
   - an ethylene acrylic acid copolymer provided as a solid and rendered soluble in an aqueous alkali; and
   - at least one softening agent;
   - wherein said mixture is in a substantially non-foamed state and the components of said mixture are present in effective saturating amounts.

2. The composition of claim 1 in which the % solid is between 20 and 60%.

3. The composition of claim 1 in which the pH is over 6.5.

4. The composition of claim 1 in which the ethylene acrylic acid co-polymer comprises between 20 and 50% of the solids (by weight) in the composition.

5. The composition of claim 1 in which said sizing agent comprises a melamine-based hydrophobe, a wax emulsion or styrene maleic anhydride.

6. The composition of claim 1 in which the sizing agent comprises between 10 and 40% by weight of the solids in the composition.

7. The composition of claim 1 in which the softening agent is non-ionic or anionic.

8. The composition of claim 7 in which the softening agent is non-ionic.

9. The composition of claim 8 in which the softening agent is an organic having between 14 and 22 carbon atoms.

10. The composition of claim 8 comprising a combination of at least two non-ionic softening agents.

11. The composition of claim 8 in which the softening agent is an ethyoxylated fatty acid, an ethoxylated fatty alcohol, a glyceryl monoester, or a combination of the above.

12. The composition of claim 1 in which one or more softening agents together comprise between 20 and 60% by weight of the solids in the composition.

13. A method for making an aqueous mixture for saturating paper stock, said method comprising providing ethylene acrylic acid co-polymer in solid form, solubilizing said solid ethylene acrylic acid co-polymer in an aqueous alkali, adding a hydrophobic sizing agent and at least one softening agent to said aqueous mixture wherein said mixture is in a substantially non-foamed state and the components of said mixture are present in effective saturating amounts.

14. A method for making saturated paper comprising;

a) providing paper; and b) saturating the paper with an aqueous mixture comprising ethylene acrylic acid co-polymer, a hydrophobic sizing agent, and at least one softening agent wherein said mixture is in a substantially non-foamed state and the components of said mixture are present in effective saturating amounts.

15. The method of claim 14 in which the paper has between 2–5% moisture just prior to the size press and treatment with the aqueous mixture allows a moisture content over 8% at the finishing reel.

16. The method of claim 13 in which the sizing mixture comprises styrene maleic anhydride.

17. The method of claim 13 in which the paper is manufactured from a paper furnish comprising a wet-strength additive.

18. The method of claim 17 in which the wet-strength additive is at least 0.5% by dry weight of the paper prior to saturation.

19. The method of claim 14 in which the paper has at least 5% by weight solids just subsequent to the size press.

* * * * *